United States Patent [19]

Mize, Jr. et al.

[11] Patent Number: 4,890,739

[45] Date of Patent: Jan. 2, 1990

[54] SEALED INTERNAL PACKAGE LABEL

[76] Inventors: James Mize, Jr., 204 Percheron Path, Simpsonville, S.C. 29681; Kent A. Davis, 200 Old Hwy. 11, Travelers Rest, S.C. 29690-8904; Henry W. Stockley, 1454 D. Dover Rd., Spartanburg, S.C. 29301

[21] Appl. No.: 135,870

[22] Filed: Dec. 21, 1987

[51] Int. Cl.[4] ..... B65D 73/00

[52] U.S. Cl. ..... 206/459; 206/524.8; 206/484

[58] Field of Search ..... 206/459, 524.8, 484, 206/484.1, 471

[56] References Cited

U.S. PATENT DOCUMENTS

| | | | |
|---|---|---|---|
| Re. 30,009 | 5/1979 | Perdue et al. . | |
| Re. 30,419 | 10/1980 | Crankshaw et al. | 156/249 |
| 2,911,305 | 11/1959 | Rumsey, Jr. | 426/87 |
| 3,373,045 | 3/1968 | Peterson | 426/87 |
| 3,491,504 | 1/1970 | Young et al. . | |
| 3,574,642 | 4/1971 | Weinke . | |
| 3,638,784 | 2/1972 | Bodolay et al. . | |
| 3,681,092 | 8/1972 | Titchenal et al. . | |
| 3,696,580 | 10/1972 | Saltzer, Sr. | 206/459 |
| 3,713,849 | 1/1973 | Grindrod et al. . | |
| 4,055,672 | 10/1977 | Hirsch et al. . | |
| 4,105,116 | 8/1978 | Jongs et al. | 206/459 |
| 4,121,956 | 10/1978 | Sample | 156/80 |
| 4,261,462 | 4/1981 | Wysocki | 206/459 |
| 4,294,859 | 10/1981 | Lundquist et al. | 426/410 |
| 4,638,913 | 1/1987 | Howe, Jr. . | |
| 4,642,279 | 2/1987 | Fesser et al. | 426/396 |
| 4,709,819 | 12/1987 | Lattuada et al. | 206/524.8 |
| 4,726,171 | 2/1988 | Kreager et al. | 53/410 |

FOREIGN PATENT DOCUMENTS

| | | |
|---|---|---|
| 245774 | 2/1961 | Australia . |
| 0075644A1 | of 0000 | European Pat. Off. . |
| 1258357 | 2/1960 | France . |
| 1286018 | 1/1961 | France . |
| 2130166B | 12/1986 | United Kingdom . |
| 2130166B | 5/1987 | United Kingdom . |

*Primary Examiner*—Joseph Man-Fu Moy

*Attorney, Agent, or Firm*—William D. Lee, Jr.; Mark B. Quatt; Jennifer L. Skord

[57] ABSTRACT

A package including a sealed, internal label comprises a product having a flat horizontal surface with a heat sealable label positioned thereon. A heat sealable web of heat formable, unshrunken film forms around the product, the web covering and heat being sealed to the label. A closure member encloses the uncovered portion of the product and being sealed to the covering web.

5 Claims, 3 Drawing Sheets

SEALED INTERNAL PACKAGE LABEL

FIELD OF THE INVENTION

This invention relates generally to vacuum skin packages and to labels for such packages. Particularly, the present invention relates to packages made from multilayer barrier films wherein the barrier layer or layers are to be peeled and separated from the non-barrier layer or layers prior to retail display of the packages and to a label and method of applying a label for such packages.

BACKGROUND OF THE INVENTION

Skin packaging can be classified as a vacuum forming process for thermoformable polymeric films. However, the term "vacuum skin packaging" or VSP as it is referred to hereinafter, refers not to the fact that the thermoformable film is formed around the product by vacuum or differential air pressure which, indeed it is, but more to the fact that the product is packaged under vacuum and the space containing the product is evacuated. Thus, in VSP processes the film formed around the product must be a barrier to oxygen, air, and other gases. However, in conventional skin packaging, a backing board which is porus or which is perforated so that a vacuum may be drawn directly through the backing board is employed.

In VSP processes, generally a vacuum chamber with an open top is used. The product on an impervious backing board is placed on a platform within the vacuum chamber. The top of the chamber is covered by a sheet of film which is clamped tightly against the chamber to form a vacuum tight closure. The chamber is evacuated while the film is heated to its forming and softening temperature. The platform is then raised to drive the product into the softened film and air pressure is used above the film to force it tightly around the product. A similar type process is disclosed in French Pat. No. 1,258,357 which issued to Alain G. Bresson on Mar. 6, 1961.

A variant of the process described in the Bresson patent is disclosed in French Pat. No. 1,286,018 which issued on Jan. 22, 1962 to LaRoach Freres Limited. The LaRoach Freres process, after the chamber has been evacuated and the product driven into the heat softened film, the vacuum is released and ambient air is permitted to enter the chamber so that the thermoplastic film molds more or less onto the product since there is a vacuum on the product side of the film and ambient air pressure on the other side of the film. Australian Pat. No. 245,774 which issued to Colbros Proprietary Limited et al on July 16, 1967 discloses a vacuum skin packaging process in which an article to be packaged is inserted within the lower half of a vacuum chamber on a backing board, a thermoplastic film is placed over the opened face of the lower half of the chamber, the chamber is closed and both halves and are brought to essentially the same state of vacuum, the film is heated and softened, and, then, atmospheric air is introduced into the upper half of the chamber so that it alone forces the thermoplastic film down around the product and against the backing board. Another version of vacuum skin packaging is disclosed in U.S. Pat. No. 3,491,504 which issued to W. E. Young et al on Jan. 27, 1970. In this version, heat softened film with equal vacuum on both sides thereof is physically moved down over a stationary product or the product moved into the film and, when air pressure is increased on the outside of the film, the softened thermoplastic film is molded onto the product.

In U.S. Pat. No. RE. 30,009, which was reissued on May 29, 1979 to Richard R. Perdue et al, a process and package is disclosed wherein a thermoformable or heat softenable film sheet is drawn by differential air pressure against the concave interior surface of the upper portion of a vacuum chamber, the film is then heated by surface contact, and then, after evacuation of the chamber, air pressure is used to blow the film down over product positioned on an impervious backing board. The resulting package comprises the product held on the backing board by the thermoformable film which has been formed around the product in the exact shape of the product so that it appears to be a "skin." The thermoformable film, as stated previously, is also gas impervious and usually will consist of a number of layers each of which performs a specific function. The product contact and backing member contact layer will be a sealing or heat sealable layer. The interior layer will typically be a barrier layer which comprises a vinylidene chloride copolymer or a hydrolyzed ethylene/vinyl-acetate copolymer; and, an outer surface layer will be provided to protect the barrier layer from scratches, pin holes or other abuse and from moisture attack. Usually the package surface will not be particularly smooth or uniform as the surface conforms to the shape of the product. Accordingly, one general object of the present invention is to provide a satisfactory method of labelling vacuum skin package which conform to the product shape.

In U.S. Pat. No. 3,574,642 which issued on Apr. 13, 1971 to Carl Frederick Weinke. A package for a method of packaging meats is disclosed. The package includes an inner oxygen-permeable member which may be either gas flushed or evacuated and an outer oxygen-impermeable member which may also be gas flushed or evacuated. The package preserves the freshness of the meat until the meat is ready to be marketed to the consumer but the meat is purplish in color. For marketing, the outer wrapper is removed and the inner package is displayed to the consumer. Being oxygen-permeable, the inner wrapper admits oxygen to the interior of the package causing the fresh meat product to change to a bright red color which the consumer associates with freshness. The inner pouch of the Weinke package may consist of polyethylene film and the outer pouches may be cellophane film with a coating of saran (vinylidene chloride copolymer). Another patent showing portions of fresh meat individually packaged in oxygen permeable plastic film and inserted into a outer container of impermeable film is U.S. Pat. No. 3,681,092 which issued to Oliver R. Technell et al on Aug. 1, 1972.

A prior art package of interest is described in U.S. Pat. No. 3,713,849 which issued to Paul E. Grindrod et al on Jan. 30, 1973. In the Grindrod et al patent a fresh meat package having an outer oxygen impermeable layer which is readily and entirely peelable from an inner oxygen-permeable layer is disclosed. The package includes means for initiating the peeling separation along an edge of the package. The outer oxygen barrier maintains meats in well preserved condition the purplish color which has low consumer appeal. Shortly prior to display for sale to the consumer the outer layer is removed by the retailer and the product develops healthy, bright red "bloom" due to the high oxygen penetration of the remaining inner film package. The materials disclosed in Grindrod et al are laminates of PVC/Saran and EVA/Saran. (EVA designates ethylene/vinyl-acetate copolymer and PVC designates polyvinyl-chloride.) The EVA and PVC layers are the inner layers and at the periphery of the package they are sealed together. The saran layers can be readily peeled from the respective EVA or PVC layers and gripping tabs are provided for initiating the peeling process.

Yet another peelable package is shown in U.S. Pat. No. 4,055,672 which issued on Oct. 25, 1977 to Arthur Hirsch et al. In the Hirsch et al patent, a semi-rigid preformed tray of oxygen impermeable material is formed, a meat product placed therein and then the tray is sealed around its upper peripheral or flange area by a composite lid which has an inner layer of oxygen impermeable material, an adhesive layer, and an outer layer of oxygen impermeable material. When the package is ready for retail displays so that oxygen can reach the fresh meat package within the tray, the outer, impermeable lid is peeled away so that the oxygen can penetrate through the remaining portion of the lid. Accordingly, another object of the present invention is to provide a package with a strippable or peelable barrier layer which has a label which is not moved or displaced by the peeling process.

In order to readily open packages where plastic film layers have been sealed together to close the package, various tear tabs and easy open mechanisms have been devised. One such easy open, delaminating seal is disclosed in U.S. Pat. No. 4,638,913 which issued on Jan. 27, 1987 to Milton A. Howe, Jr. In this disclosure, two grippable film folds are provided and the folds, when pulled apart, will rupture one of the outer layers of the sealed together film and delaminate the film to its edge. In such a case, of course, the bond strength between the two sealed together films must be greater than the layer to layer bond of the film. Accordingly, it is still another object of the invention to provide a package which it is readily openable without removing or displacing the label for the package. In the prior art it has been known to seal a label between two layers of thermoplastic material to protect the label or to separate the label from the contents of the package. Such a label sealing method is shown in U.S. Pat. No. 3,638,784 which issued on Feb. 1, 1972. However, positioning the label a separate compartment or separating it by an additional film member means higher costs in both film and labor. Accordingly, it is one object of the present invention to provide a simplified method of providing a label which is sealed internally in the package.

In the prior art, when labels are placed inside a package, these labels can be displaced or moved within the package as it moves through the handling and distribution chain. Accordingly, it is another object of the present invention to provide an internal label which minimizes the chances that it will move from its original location.

When packaging foods which may exude fluids such as fresh red meat will, if a label is placed on the inside of the package it will tend to become discolored and in some cases unreadable due to the migration of the fluids over the visible label area. Accordingly, it is yet another object of the present invention to provide a label which will not be rendered illegible by the presence of fluids within the package.

When cold, wet surfaces are to be labeled as is the case when meat wrapped in plastic film for showcase display is to be labeled, it is often difficult to get the label to stick to the surface of the film by any quick means as the surface is soft and spongy and label adhesives sometimes tend to resist sticking to a moist, cold surface. Often, such labels will come off the package or become unreadable because of the crush and abuse from adjacent packages in transportation, storage, or display. Accordingly, it is still another object of the present invention to provide a label which will remain with the package and continue to be legible throughout the handling and display process.

These and other objects and the accomplishment thereof will become apparent to those skilled in the art from the following Summary of Invention, Description of the Drawings, and Detailed Description.

SUMMARY OF THE INVENTION

In one aspect, the present invention is a method of providing a sealed internal label for a product packaged in thermoplastic film comprising the steps of: preparing a label having a heat sealable surface, said heat sealable surface carrying the information disclosed by the label; placing the label on a product to be packaged with the heat sealable surface facing outwardly; enclosing at least the part of the product upon which the label has been placed with a heat sealable, thermoplastic film which is heated to a sealing temperature whereby when it contacts the label as a product is enclosed, the label seals thereto; further enclosing the product by sealing the film to itself or to a second heat sealable member thereby completing the enclosure of the product and forming a package with a sealed internal label.

In another aspect, the present invention is a method of providing a sealed internal label for a product within a skin package comprising the steps of: placing the product on a support member having a heat sealable surface; placing a label whose printed surface is heat sealable on said product with the printed side facing upwardly; heating a covering film having a heat sealable surface to its softening temperature; and draping the covering film over the product so that it seals to the label and further draping the film around the product so that it seals to the support member around the periphery of the product. In one embodiment, the products are arranged on a support member in an array of columns and rows and labels on strips can be placed across and down each column as the products are moved in the direction of the rows.

In still another aspect, the present invention is a method of providing a sealed internal label for a product within a vacuum skin package comprising the steps of: positioning a product on a gas impervious support member, said product having a relatively flat, horizontal upper surface; placing a label on said horizontal upper surface of said product, said label having a heat sealable surface, the label being positioned so that the heat sealing surface faces upwardly; putting the support member, product, and label in a vacuum chamber; providing a heat sealable covering web and heating it to its sealing temperature; positioning said heated covering web over the product, supporting member, and label; evacuating the space containing the product while holding the web apart therefrom; molding the heated web around the product and into sealing contact with the label; and, continuing the molding of the film around the product and into sealing contact with the support member to complete the formation of a vacuum skin package. The support member is preferably a gas impervious tray and the covering or forming web comprises a composite of two films, one being a peelable, gas barrier film which can be removed to expose the other film which is a heat sealable, gas previous film that allows oxygen to contact the package contents when the peelable web is removed.

In yet another aspect, the present invention is a package having a sealable, internal label comprising: a product having a relatively flat, horizontal surface; a heat sealable label positioned on said surface; a heat sealable web formed at least partially around said product, said web covering and being heat sealed to said label; and, a support or closure member enclosing the uncovered portion of said product and being sealed to said covering web.

DESCRIPTION OF THE DRAWINGS

In the drawings which are attached hereto and made a part of this disclosure.

DETAILED DESCRIPTION

Figure 1:
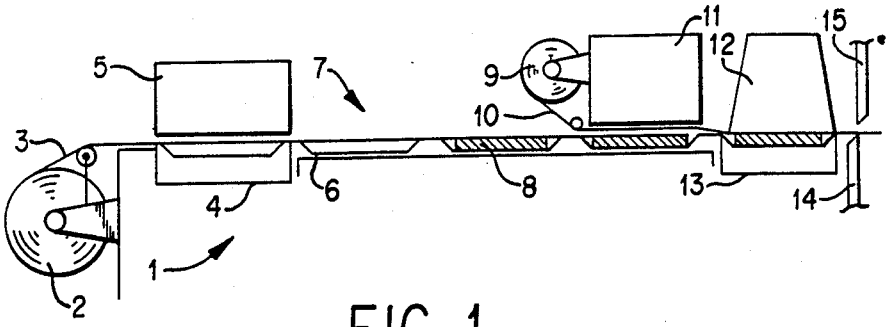
FIG. 1 is a schematic representation of a continuous process by which the present invention can be accomplished.

Referring first to FIG. 1, one embodiment of a process for making a vacuum skin package of the type which can utilize the present invention will be described. The drawing is a schematic and represents a process described in U.K. Pat. No. 2,130,166B wherein the application was published May 31, 1984 and the patent published Dec. 17, 1986. This patent is incorporated herein by reference. In FIG. 1, sheet-like material 3 to form the support or bottom web is unrolled from roll 2. The bottom web 3 for vacuum skin packaging purposes must be a relatively impervious sheet and preferably will comprise a base layer of a thermoformable material such as semi-rigid polyvinyl chloride (PVC) which is coated with saran (vinylidene chloride copolymer or PVDC) which coating is coated with a heat sealable material such as a Surlyn brand ionomer or a suitable ethylene/vinyl-acetate copolymer (EVA). As the material moves to the right it passes over a mold 4 for the tray and under a heater unit 5. At this station, a thermoforming operation takes place in which the web 3 is heated by heater 5 by preferably using a heater plate in which vacuum holes are placed to draw the web 3 up against the heater plate until the web is heated to its softening and forming temperature and then release the web at which time vacuum in holes distributed across the surface of the mold 4 will draw the softened and formable web 3 down into the mold where it assumes the shape of the mold. After cooling and setting, the now formed tray 6 is moved to the right to the product loading station 7. As an alternate, mold 4 and heater 5 can be eliminated and a flat support web be used instead.

Figure 4:
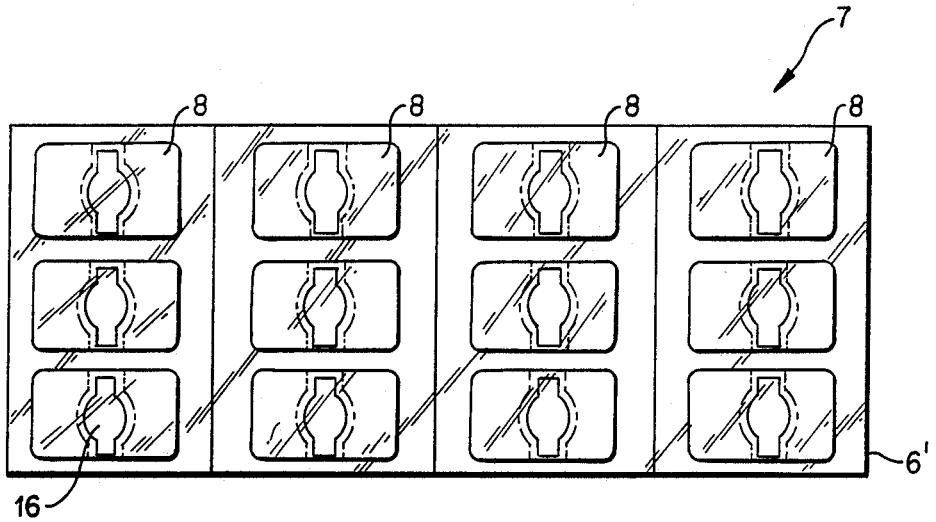
FIG. 4 is a top view and schematic representation of an array of packages at a loading station with labels placed thereon.
Figure 5:
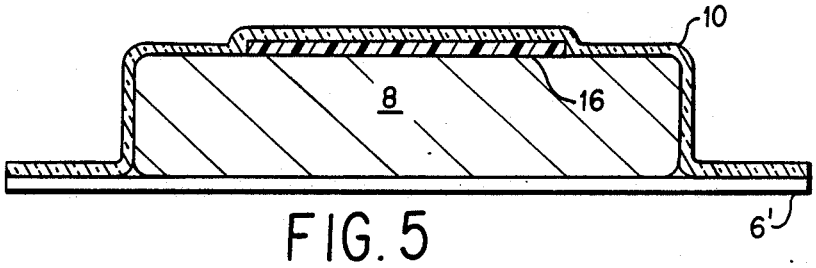
FIG. 5 is a cross sectional representation of a completed package of the type shown in FIG. 4.

At the loading station 7, product 8 to be packaged will be loaded into the tray. The trays in one embodiment are formed three across so that each set of trays as they leave the mold 4 form a column of trays across the width of the web. Looking at FIGS. 4 and 7 this arrangement can be seen where products 8 are loaded into either the tray cavity or when a tray is not used, onto the flat backing member or support web 6'. The operator at station 7 will place a product either in each tray or on the appropriate spot of the flat backing member 6. One preferred product is beefsteak 1" to 1½" thick. Alternately, rectangular blocks of cheese or other meat or food products can be packaged.

Figure 7:
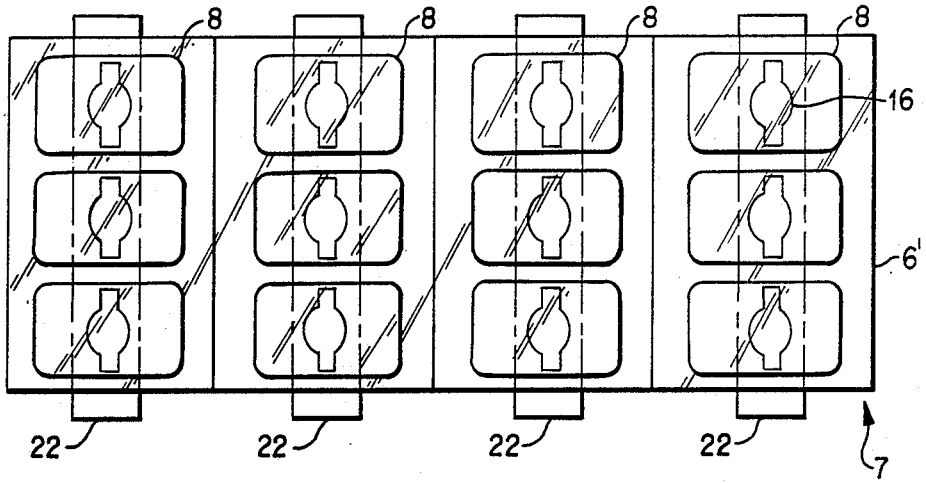
FIG. 7 is a schematic representation of an array of products at a loading station having labels on a strip positioned on each product in a column.
Figure 8:
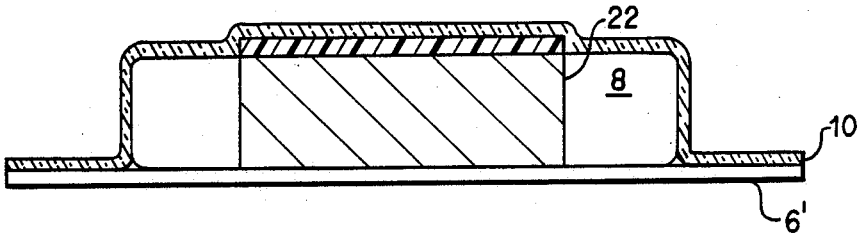
FIG. 8 is a schematic representation of a cross section through one of the products shown in FIG. 7; and, FIG. 9 is the same cross section as FIG. 8 but showing the covering web with a peelable barrier film.
Figure 9:
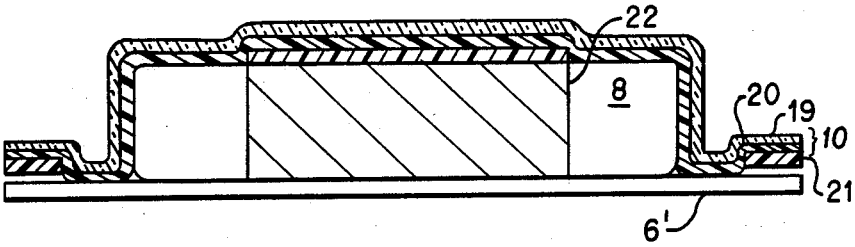

At loading station 7 when the products 8 are loaded the operator then places a label 16 on the horizontal upper surface of the products so that the heat sealable, printed surface of the label faces upwardly. Alternately, as shown in FIG. 7 the labels may be on a continuous strip and held by a roll and dispensed adjacent the column of products much like a "Scotch" tape dispenser.

Figure 6:
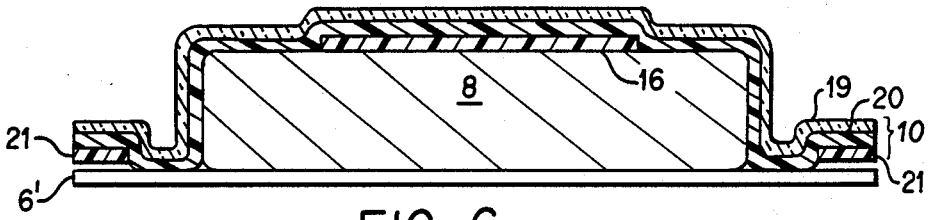
FIG. 6 is a schematic representation of a cross section of a package of the type which has been made from the array shown in FIG. 4 and differs from FIG. 5 in that a composite covering web having peelable and nonpeelable films is shown.

When the product with the label thereon has been properly positioned, the array, usually consisting of one column of products which in this instance are products three across moves to the preheating station where the covering web 10 is fed from roll 9. The covering or forming web 10 may be a single layer film or may be a two component or composite film as can be seen in FIGS. 6 and 7. The outer film 19 can be a layer of saran and the inner or sealable layer 20 can be a layer of PVC. Such a film is described in the above mentioned U.S. Pat. No. 3,574,642 to Weinke. In general, any suitable covering or thermoforming web may be used if the peelable feature is not desired. Since the preferred embodiment is a sealed internal layer in a package which is made by the vacuum skin packaging process being described, any suitable forming web can be used but it must contain a gas barrier layer. Such a film will usually be a multi-layer film comprising a sealing layer of either an ionomer or branched, low density polyethylene (LDPE) or ethylene/vinyl-acetate copolymer (EVA). A barrier layer will be included which will comprise either saran or ethylene/vinyl alcohol (EVOH) which is sometimes referred to as hydrolyzed ethylene/vinyl acetate copolymer. Also included is a forming or support layer which may be PVC, LDPE, EVA, LLDPE (linear low density polyethylene), or VLDPE (very low or ultra low density polyethylene). Thus, in schematic fashion, the forming web preferably comprises these components: sealing layer/barrier layer/formable layer. Such a film is, of course, not limited to three layers.

Figure 2:
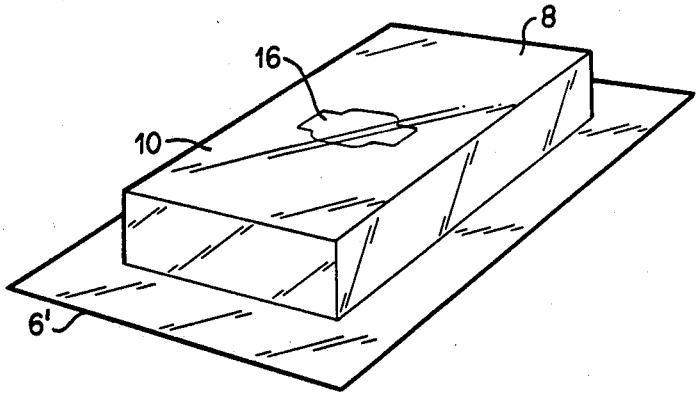
FIG. 2 is a perspective representation of a package showing one embodiment of the present invention.
Figure 3:
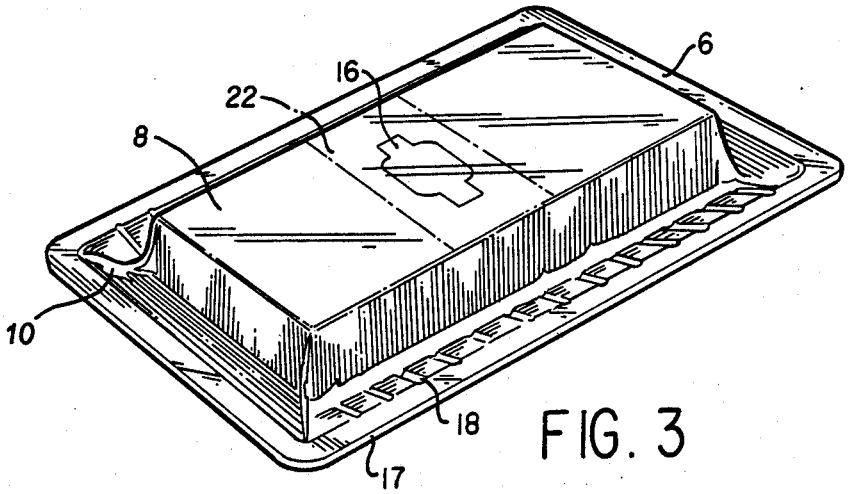
FIG. 3 is a perspective view of a package showing one embodiment of the present invention.

When the forming web 10 is preheated at station 11 the heated film and product on a support web are moved to the next station 12, 13 where the product is enclosed in a vacuum chamber having upper action or covering dome 12 and lower or bottom section half 13. Inside the dome the covering web 10 may be drawn up against the heated interior of the dome and held there in a concave fashion while the product containing space is evacuated in accordance with a preferred process described in the above mentioned U.S. Pat. No. Re. 30,009 to Perdue. When the chamber has been evacuated, the web 10 which has been held by vacuum against the dome interior surface is released and atmospheric pressure is applied on its upper surface thus causing the pressure differential between atmospheric pressure in the evacuated chamber to force the heated film down around the product and assume the product's shape. As the sealable surface of the covering web 10 comes in contact with the label 16 it will seal and adhere thereto so that the individually finished packages will have cross sections as shown in FIGS. 5, 6, 8 or 9 and the overall appearance will be a package such as that shown in FIG. 2 where the support web 6' is flat or in FIG. 6 where the support web is a tray.

As can be seen in FIGS. 5, 6, 8, and 9, the covering web by reason of the pressure differential is forced against the label 16 and adheres firmly and smoothly thereto. It is preferred that the product surface be relatively flat and smooth but the vacuum skin process can accommodate varying shapes and surface non-uniformities.

Numerous label embodiments may be used in the present invention. One preferred label is paper with a water proof coating on the lower side and which is printed with the label information on the upper side and afterwards coated with a heat sealable adhesive which can be a molten ionomeric resin or an EVA copolymer. These adhesive coatings are well known to those skilled in the art. The film at its forming temperature will readily seal to such a label and adhere thereto. The uniform pressure in a vacuum skin packaging process causes the label to be sealed all around and fluids from the product will not get between the label and the covering web.

Another embodiment is to print the label information directly onto a heat sealable substrate which can be made from LDPE, EVA, Ionomer or the like. To be printable surfaces such as those comprising may require corona or other treatment which is well known to those skilled in the art of printing plastic surfaces.

The invention will find significant use and advantage in vacuum skin packages which are used to not only store fresh red meat products such as beef, lamb, and pork, but also to display them in the retail store showcase. In such a package, a beefsteak 8 (refer to FIGS. 6 and 9) is positioned on an impervious support web 6' and covered by a composite film 10 having a barrier layer 19 and a heat sealable layer 20. When packaged, the steak 8 is under vacuum and oxygen has been removed completely from the interior of the package during the vacuum skin packaging process. In this condition, the meat will turn a "purplish" color but may be stored, preferably below about 37° F., and more preferably at about 28° to 32° F., unfrozen for periods up to 21 to 30 days. When ready for the retail showcase, tab 21 is simply lifted up and the heat sealable layer 20 which has a lower cohesive strength than the bond force between layer 20 and support member 6' will rupture and allow the peelable barrier layer 19 to be removed. When this barrier layer is removed, the heat sealable layer 20 which is a gas previous film, will allow the penetration of oxygen to the purplish colored meat and as the oxygen reacts the meat will "bloom" and turn a bright red which makes the product quite appealing to the retail purchaser. The label 16 being beneath the sealable film 20 and held in place by being sealed thereto will not removed or displaced by the peeling away of layer 19 and because it is sealed to film 20 juices and moisture will not get between the label 16 and film 20 to give the label an unsightly appearance.

As used herein, the terms "impervious" and "barrier" relating to webs, substrates and films formed from thermoplastic materials mean a film having an oxygen transmission of less than about 100 cc $O_2$ per 100 square inches per mil of thickness per 24 hour period at 73° F. and a "gas pervious" or "gas permeable" film or covering web means a film having a transmission rate for oxygen of greater than 2000.

The foregoing description is by way of illustration and is not limiting on the scope of the invention described as other embodiments and applications of the invention will become evident to those skilled in the art as they become familiar with the invention. The invention is limited only by the scope of the claims which follow and are appended hereto.

We claim:

1. A package having a sealed, internal label comprising:

(a) a product having a relatively flat, horizontal surface;

(b) a heat sealable label positioned on said surface;

(c) a heat sealable web of heat formable, substantially unshrunken film formed at least partially around said product, said web covering and heat being sealed to said label, and (d) a support or closure member enclosing the uncovered portion of said product and being sealed to said covering web.

2. The package of claim 1 wherein the product is a cut of fresh red meat placed on a support member.

3. The package of claim 1 wherein the package is evacuated.

4. The package of claim 2 wherein the covering web is a composite web comprising a peelable gas impermeable film and a gas permeable, heat sealable film.

5. The package of claim 4 wherein the support member is a heat sealable, gas impervious tray.

* * * * *

UNITED STATES PATENT AND TRADEMARK OFFICE

CERTIFICATE OF CORRECTION

PATENT NO. : 4,890,739

DATED : January 2, 1990

INVENTOR(S) : James Mize, Jr. et al

It is certified that error appears in the above-identified patent and that said Letters Patent is hereby corrected as shown below:

On the title page:

The patent should be assigned to W. R. Grace & Co.

Signed and Sealed this

Fifteenth Day of January, 1991

*Attest:*

*Attesting Officer*

HARRY F. MANBECK, JR.

*Commissioner of Patents and Trademarks*